United States Patent [19]

Klein

[11] 4,287,846

[45] Sep. 8, 1981

[54] INTERMITTENT ADHESIVE APPLICATOR

[75] Inventor: Gary S. Klein, Aurora, Ohio

[73] Assignee: Voplex Corporation, Pittsford, N.Y.

[21] Appl. No.: 142,089

[22] Filed: Apr. 21, 1980

[51] Int. Cl.[3] ..... B05C 1/08; B05C 1/16

[52] U.S. Cl. ..... 118/212; 118/203; 118/249; 118/262

[58] Field of Search ..... 118/203, 212, 262, 221, 118/225, 249, 234; 101/153

[56] References Cited

U.S. PATENT DOCUMENTS

| | | | |
|---|---|---|---|
| 1,191,537 | 7/1916 | Schall | 118/203 |
| 2,729,193 | 1/1956 | Scholl | 118/203 X |
| 3,333,568 | 8/1967 | Przybilla | 118/203 X |
| 3,830,197 | 8/1974 | Romaine | 118/262 X |

*Primary Examiner*—John P. McIntosh

*Attorney, Agent, or Firm*—Stonebraker, Shepard & Stephens

[57] ABSTRACT

An applicator 15 deposits a solvent-carried adhesive intermittently along a moving strip 10. A sump 26 is arranged below strip 10 to contain a quantity of the solvent 27, and an adhesive wheel 16 rotates with its lower region immersed in the solvent. Adhesive wheel 16 has a continuous periphery on which adhesive is continuously applied, and an applicator wheel 17 rotates against the adhesive wheel and the bottom of the strip above the sump. Applicator wheel 17 a as an intermittent peripheral surface 18 that receives adhesive from the adhesive wheel and applies it in an intermittent pattern to the bottom of the moving strip. The sump, the adhesive wheel, the applicator wheel, and the region of contact between the applicator wheel and the strip are enclosed to retain a substantially saturated solvent vapor atmosphere within the enclosure 25 to inhibit the evaporation of solvent from the adhesive.

8 Claims, 3 Drawing Figures

INTERMITTENT ADHESIVE APPLICATOR

BACKGROUND OF THE INVENTION

This invention solves the problem of applying a vinyl chloride monomer adhesive in intermittent dabs on the moving bottom of a polyvinyl chloride substrate of an automotive trim strip that will later be dielectrically bonded in place. Other workers discovered that intermittent dabs of the vinyl chloride monomer adhesive enhances the thermal bonding of automotive trim strips to either plastic or metal surfaces. This adhesive is difficult to manage, however; and many failures occurred before I devised a satisfactory way of applying it intermittently to the bottom of an automotive trim strip moving at production speeds.

The invention aims at simplicity, effectiveness, and economy in intermittently applying an adhesive rapidly and reliably. Although it was devised for applying a particular adhesive to the polyvinyl chloride bottom of an automotive trim strip, it can be used for different adhesives applied to different surfaces.

SUMMARY OF THE INVENTION

An applicator deposits a solvent-carried adhesive intermittently along a moving strip. A sump arranged below the strip contains a quantity of the solvent, and an adhesive wheel rotates below the strip with its lower region immersed in the solvent in the sump. The adhesive wheel has a continuous peripheral surface receiving continuously applied adhesive at a level above the solvent in the sump. An applicator wheel rotating below the strip and above the solvent has an intermittent peripheral surface running against the adhesive wheel and the moving strip to receive adhesive from the adhesive wheel and apply it intermittently to the strip. The adhesive and applicator wheels are rotated at peripheral surface speeds approximately equal to the speed of the moving strip. The sump, adhesive wheel, and applicator wheel are enclosed with an entrance and exit provided for the strip to move through the enclosure in contact with the applicator wheel. The enclosure is sufficiently closed to retain a substantially saturated solvent vapor atmosphere to inhibit evaporation of the solvent from the adhesive.

DRAWINGS

DETAILED DESCRIPTION

Figure 1:
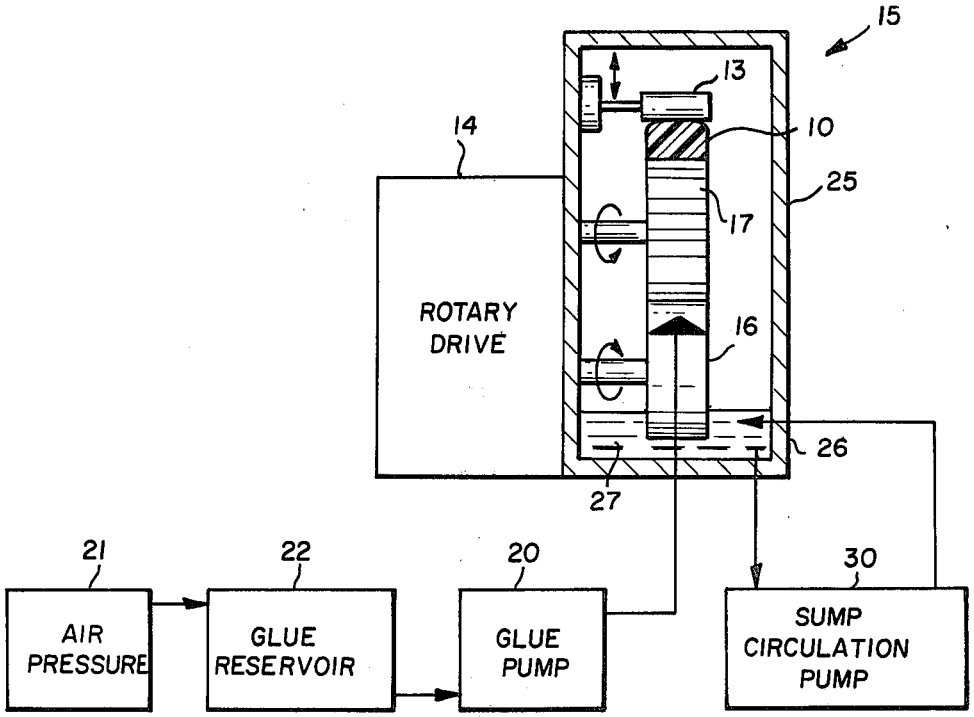
FIG. 1 is a partially schematic side elevational view of a preferred embodiment of the inventive adhesive applicator.
Figure 2:
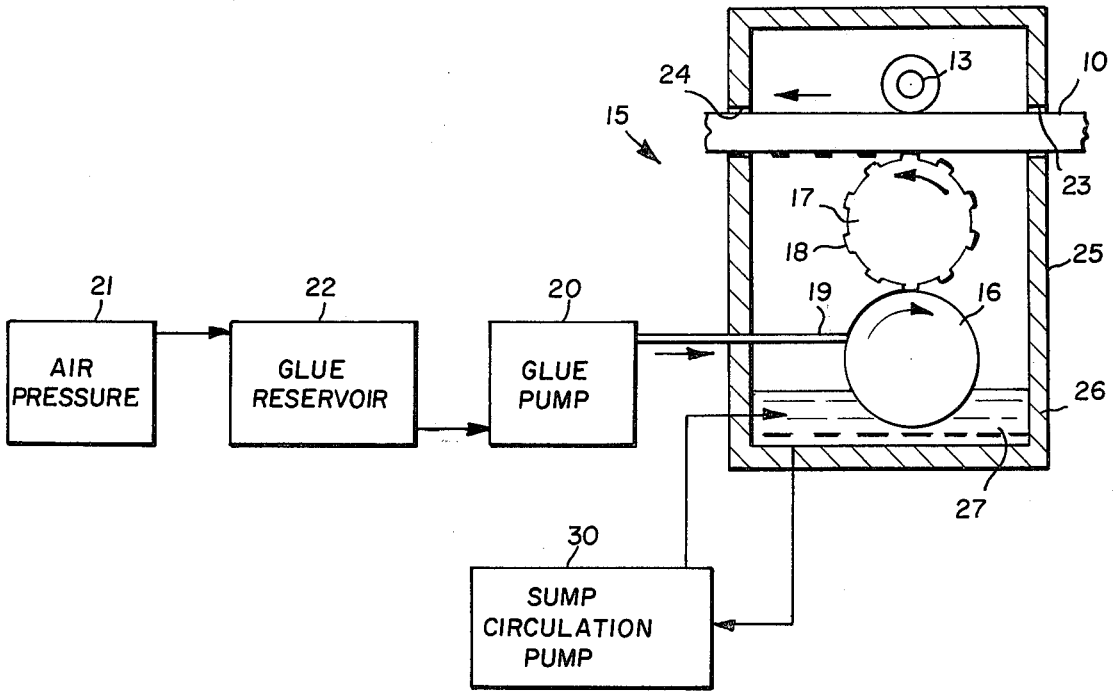
FIG. 2 is a partially schematic, front elevational view of the adhesive applicator of FIG. 1.

Although the inventive applicator can be used in other circumstances requiring an intermittent adhesive coating, the illustrated preferred embodiment as described below was devised for depositing a solvent-carried adhesive intermittently along a moving strip. The strip 10 in this case is an automotive trim strip having a polyvinyl chloride substrate providing a bottom surface and usually having a metallic laminate on its upper surface. Strip 10 can have many shapes and structures in the automotive industry where it is thermally or dielectrically bonded to plastic and metal support surfaces.

The adhesive is a vinyl chloride monomer known in the automotive industry to enhance the thermal bonding of trim strip 10 to any support surface, providing the adhesive is intermittently coated on the bottom of trim strip 10. A preferred intermittent glue pattern for automotive uses is dabs about one quarter inch long separated by one quarter inch of uncoated space so that about half of the bottom length of trim strip 10 is coated with adhesive dabs about a quarter inch long. Production requirements and existing machinery for making trim strip 10 require that the quarter inch adhesive dabs be applied at a rate of about 24 per second. Of course, other speeds and spacings are possible.

The vinyl chloride monomer glue has a thick consistency, is stringy and sticky, and dries rapidly so that it defied many attempts at intermittent coating. The adhesive is carried by a solvent; and although many solvents are possible, the solvent preferred for a vinyl chloride monomer glue is methyl ethyl ketone. The solvent and monomer mixture must be adjusted to form a thick consistency so that the glue is coatable and so that not too much solvent is present. Excess solvent can migrate through the polyvinyl chloride substrate and damage strip 10 by leaving it deformed in the pattern of the intermittent coating applied to its bottom surface.

Attempts at applying the glue in a zigzag pattern and bouncing the moving strip against a glue applier resulted in bridging and stringing of the adhesive. Nozzles for applying the adhesive can easily clog and cannot be operated intermittently, and any chance for glue to build up or accumulate somewhere causes a failure. Experience shows that this can happen in a minute or two.

Applicator 15 succeeded, however, by using an adhesive wheel 16 continuously coated with glue and an intermittent applicator wheel 17 that transfers glue in intermittent dabs from adhesive wheel 16 to the bottom of strip 10 under conditions explained below. Wheels 16 and 17 are counterrotated so that applicator wheel 17 runs in contact with adhesive wheel 16 and the bottom of strip 10.

Drive 14 formed of conventional components including a motor, speed reducer, and gears counterrotates wheels 16 and 17 at a peripheral surface speed approximately matching the speed of strip 10. A vertically adjustable pressure roller 13 rolls against the top of strip 10 and holds strip 10 against applicator wheel 17. Wheel 16 was formed of polytetrafluoroethylene for its excellent release properties, but other materials may also work. Cost and compatibility with the particular adhesive being used control the selection. Applicator wheel 17 was formed of felt, but again, other materials may also work.

The periphery of applicator wheel 17 is notched to form intermittent surfaces 18 that contact adhesive wheel 16 and the bottom of strip 10 and grooves or valleys separating intermittent surfaces 18. The length and separation of surfaces 18 establishes the intermittent pattern and spacing of the glue dabs on the bottom of strip 10. Wheel 17 preferably has a slightly different diameter from wheel 16 so that intermittent surfaces 18 eventually contact the entire surface of adhesive wheel 16 during counterrotation.

A positive displacement pump 20, such as a gear pump, forces glue continuously through a nozzle 19 onto the peripheral surface of adhesive wheel 16 as schematically illustrated. Positive displacement pumping is preferred to keep the glue moving evenly so that it cannot clog in nozzle 19. A source of air pressure 21 forces adhesive from reservoir 22 to pump 20 for positive pumping to adhesive wheel 16. Nozzle 19 is wide enough to coat glue continuously across the full width of the peripheral surface of adhesive wheel 16.

The glue application occurs within a box or enclosure 25 that encloses adhesive wheel 16, applicator wheel 17, roller 13, and the region where adhesive is applied to the bottom of strip 10. An entrance opening 23 and an exit opening 24 in the walls of box 25 are just large enough to allow strip 10 to pass through the upper region of enclosure 25 without rubbing against enclosure walls. Otherwise, box 25 is tightly closed.

The bottom of enclosure 25 forms a sump 26 filled with the same solvent 27 that carries the adhesive. Solvent 27, which can be volatile methyl ethyl ketone, is free to evaporate within enclosure 25 but cannot readily escape, because box 25 is substantially closed. This keeps the atmosphere within box 25 substantially saturated with solvent vapor, which inhibits the evaporation of solvent from the glue. The adhesive is then much less likely to dry during its brief encounter with the saturated solvent vapor atmosphere in enclosure 25 as the glue travels from adhesive wheel 16 to the intermittent surfaces 18 of applicator wheel 17 and onto the bottom of strip 10. This effectively prevents buildup of adhesive on wheels 16 and 17.

Adhesive wheel 16 has its lower periphery immersed in solvent 27 in sump 26 so that wheel 16 cleans its peripheral surface as it rotates in solvent. This tends to remove glue that is not picked up by the intermittent surface 18 of applicator wheel 17 and is another measure that helps in preventing undesirable glue buildup.

A sump circulation pump 30 pumps solvent 27 out of and into sump 26 to circulate a quantity of solvent 27 and keep a fresh solvent surface encouraging evaporation and maintaining a substantially saturated solvent vapor atmosphere within enclosure 25. The pumping or circulating of solvent 27 is not critical and can be accomplished in other ways. As glue accumulates in solvent 27 after extended operation, solvent 27 is removed and replaced with fresh solvent; and the glue-laden solvent can be used to dilute the glue supply to the proper consistency.

Figure 3:
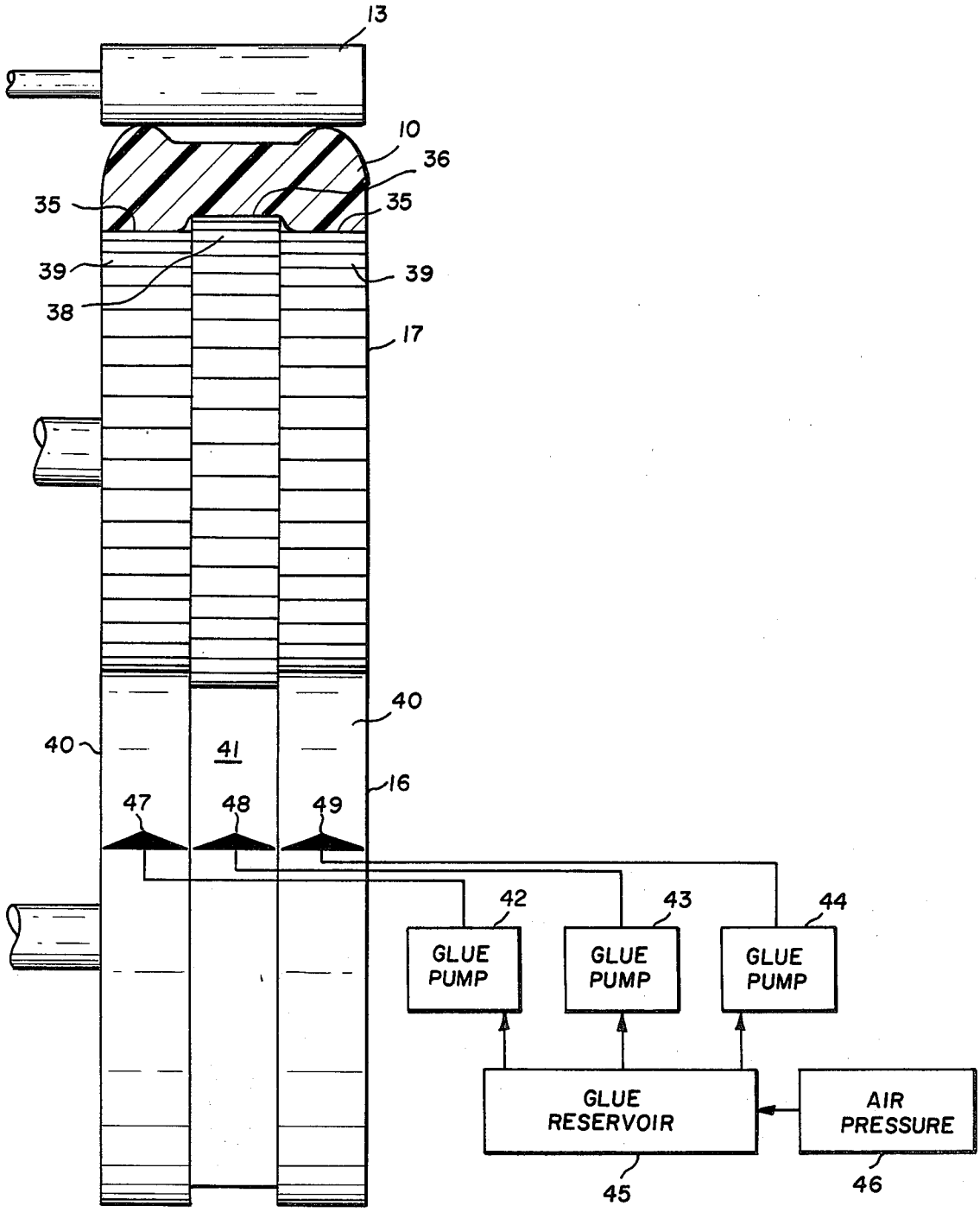
FIG. 3 is an enlarged, partially schematic, fragmentary side elevational view of the inventive applicator coating a particular configuration of surface.

FIG. 3 shows how the inventive applicator can be modified to apply adhesive intermittently to different shaped surfaces. Strip 10 has a grooved bottom with side edges 35 at a lower level and a central groove at an upper level. Applicator wheel 17 has a corresponding peripheral intermittent surface with an intermittent upper surface 38 at a larger radius and intermittent lower sides surfaces 39 at a smaller radius to contact the central groove 36 and side edges 35 of strip 10. Adhesive wheel 16 also has three peripheral surfaces to mate with applicator wheel 17. On adhesive wheel 16, a pair of side surfaces 40 have a larger radius and central surface 41 has a smaller radius.

Experience has shown that a single glue pump cannot positively and evenly supply three nozzles without one of them clogging. Three glue pumps 42–44 fed by a single glue reservoir 45 supplied with an air pressure source 46 pump glue through three separate lines to three schematically illustrated nozzles 47–49 for continuously coating adhesive wheel surfaces 40 and 41.

Other shapes or surfaces can also be glued intermittently with the inventive applicator by matching the applicator and adhesive wheel surfaces to the shape of the surface being coated. The intermittent pattern of the coating can be varied by changing the length and spacing of the intermittent peripheral surface of applicator wheel 17, and glue can even be applied continuously by giving applicator wheel 17 a continuous peripheral surface.

I claim:

1. An applicator for depositing a solvent-carried adhesive intermittently along a moving strip, said applicator comprising:

a. a sump arranged below said strip and containing a quantity of the solvent carrying said adhesive;

b. an adhesive wheel arranged to rotate below said strip and having a lower region immersed in said solvent in said sump;

c. said adhesive wheel having a continuous peripheral surface for receiving said adhesive;

d. means for continuously applying said adhesive to said continuous surface of said rotating adhesive wheel above said solvent in said sump;

e. an applicator wheel arranged to rotate below said strip and above said solvent in said sump;

f. said applicator wheel having an intermittent peripheral surface;

g. said applicator wheel being arranged with said intermittent peripheral surface running against said adhesive wheel and said moving strip to receive spaced increments of the continuous adhesive from said adhesive wheel and apply said received adhesive intermittently to said strip while leaving unreceived, spaced increments of adhesive on said adhesive wheel for removal in said solvent in said sump;

h. means for rotating said adhesive wheel and said applicator wheel at peripheral surface speeds approximately equal to the speed of said strip;

i. an enclosure enclosing said sump, said adhesive wheel, said applicator wheel, and the region of contact betwen said applicator wheel and said strip;

j. an entrance and exit for said strip to move through said enclosure in contact with said applicator wheel; and k. said enclosure being sufficiently closed to retain a substantially saturated solvent vapor atmosphere within said enclosure to inhibit evaporation of solvent from said adhesive.

2. The applicator of claim 1 including a pump for circulating said solvent through said sump.

3. The applicator of claim 1 wherein said adhesiveapplying means includes a nozzle adjacent said adhesive wheel and a positive displacement pump for continuously forcing said adhesive through said nozzle and onto said adhesive wheel.

4. The applicator of claim 1 including a roller arranged for pressing said strip into said contact with said applicator wheel.

5. The applicator of claim 1 wherein said adhesive wheel has a plurality of said continuous surfaces at different radii for receiving said adhesive, said applicator wheel has a plurality of said intermittent peripheral surfaces at different radii for running contact with said continuous surfaces of said adhesive wheel, and said strip has a plurality of levels at different elevations contacting said intermittent surfaces of said applicator wheel and receiving said adhesive.

6. The applicator of claim 5 including a separate nozzle and positive displacement pump for continuously applying adhesive to each of said plurality of continuous surfaces of said adhesive wheel.

7. The applicator of claim 6 including a pump for circulating said solvent through said sump.

8. The applicator of claim 7 including a roller arranged for pressing said strip into said contact with said applicator wheel.

* * * * *